US008708372B2

(12) United States Patent
Büttner

(10) Patent No.: US 8,708,372 B2
(45) Date of Patent: Apr. 29, 2014

(54) DEVICE FOR HOLDING SHEETS IN A BINDER WHICH FORM A FOLDED STACK

(75) Inventor: Matthias Büttner, Alsting (FR)

(73) Assignee: X7 G.m.b.H., Bertrange (LU)

( * ) Notice: Subject to any disclaimer, the term of this patent is extended or adjusted under 35 U.S.C. 154(b) by 554 days.

(21) Appl. No.: 11/990,525

(22) PCT Filed: Aug. 10, 2006

(86) PCT No.: PCT/EP2006/007912

§ 371 (c)(1),
(2), (4) Date: Apr. 28, 2009

(87) PCT Pub. No.: WO2007/022870

PCT Pub. Date: Mar. 1, 2007

(65) Prior Publication Data

US 2010/0007126 A1 Jan. 14, 2010

(30) Foreign Application Priority Data

Aug. 22, 2005 (DE) ..... 10 2005 039 547

(51) Int. Cl.
*B42D 3/00* (2006.01)

(52) U.S. Cl.
USPC ..... 281/21.1; 281/48

(58) Field of Classification Search
USPC ..... 281/46–50, 21.2
See application file for complete search history.

(56) References Cited

U.S. PATENT DOCUMENTS

| | | | | | |
|---|---|---|---|---|---|
| 691,983 | A | * | 1/1902 | Swanney | 281/50 |
| 730,727 | A | * | 6/1903 | Wolfe | 281/48 |
| 1,217,625 | A | * | 2/1917 | Osterhout | 281/48 |
| 1,327,186 | A | * | 1/1920 | Anderson | 281/49 |
| 1,422,696 | A | * | 7/1922 | Goodyear | 281/48 |
| 1,498,988 | A | * | 6/1924 | Battle | 281/50 |
| 1,826,627 | A | | 9/1929 | Meyerson | |
| 2,157,080 | A | * | 5/1939 | Mandel | 281/47 |
| 2,236,771 | A | * | 4/1941 | Davio | 281/48 |
| 2,797,461 | A | * | 7/1957 | Osher | 402/62 |
| 3,018,532 | A | * | 1/1962 | Rinaldi | 281/46 |
| 3,971,572 | A | * | 7/1976 | Fenkel | 281/46 |
| 4,652,013 | A | * | 3/1987 | Azzato | 281/46 |
| 4,840,407 | A | * | 6/1989 | Schroeder | 281/48 |
| 5,195,782 | A | * | 3/1993 | Schroeder | 281/48 |
| 6,254,135 | B1 | * | 7/2001 | Girard | 281/21.1 |
| 7,614,815 | B1 | * | 11/2009 | Huang | 402/79 |

FOREIGN PATENT DOCUMENTS

| | | |
|---|---|---|
| CH | 346 522 | 8/1959 |
| GB | 210 098 | 1/1924 |
| GB | 1 190 056 | 4/1970 |
| WO | 01/89859 | 11/2001 |

* cited by examiner

*Primary Examiner* — Casandra Davis
(74) *Attorney, Agent, or Firm* — Lucas & Mercanti, LLP

(57) ABSTRACT

The invention relates to a device for holding sheets in a binder which form a folded stack, comprising a holding element (3) connected to the spine (2) of the binder (1). According to the invention, the holding element (3) engages behind the innermost sheet of the stack (4) at its fold (9).

8 Claims, 4 Drawing Sheets

DEVICE FOR HOLDING SHEETS IN A BINDER WHICH FORM A FOLDED STACK

BACKGROUND OF THE INVENTION

The invention concerns a device for holding sheets that form a folded stack in a binder, with a holding element connected with the spine of the binder.

WO 01/89859 A1 discloses a sheet binding system in which a folded stack of sheets is joined with a retaining rod that extends along the outside of the fold of the stack. This retaining rod in turn can be detachably joined with the aforesaid holding element, and several holding elements for holding one stack of sheets each can be provided in the binder. The retaining rod stabilizes the stack of sheets, so that it can also be detached from the binder, e.g., as a notebook or calendar.

SUMMARY OF THE INVENTION

The objective of the invention is to create a new holding device of the aforementioned type, which has a simplified design compared to the sheet binding system described in WO 01/89859 A1.

The device of the invention which achieves this objective is characterized by the fact that the holding element grips behind the innermost sheet of the stack at the fold.

In accordance with the invention, the holding element, which is preferably directly joined with the binder, directly grips the folded stack. To stabilize the stack, its sheets can be attached by staples in the area of the adjacent folds.

The section of the holding element that grips behind the innermost sheet has a strand-like design and in a holding position, it borders the fold along its length. This strand, which is designed, e.g., as a thin wire or thin strip, is attached on the inside against the fold of the innermost sheet and holds the stack in the binder.

The holding element can grip the stack around and behind its edge.

In a preferred embodiment of the invention, at least one opening that passes all the way through is formed in the stack or, as is especially preferred, a peripheral recess is formed in it, into which enters a section of the holding element that extends perpendicularly to the fold. The holding element grips behind the stack of sheets, i.e., it either grips behind at the edge or grips behind a passage formed in the stack. As a result of the engagement of the aforesaid section in the peripheral recess or passage, the stack is secured against displacement perpendicularly to the fold, which is advantageous especially when the stack is opened together with the binder, and the opened stack could be laterally displaced towards the binder without this engagement.

The opening or peripheral recess is preferably formed symmetrically to the fold, i.e., to a plane which perpendicularly intersects the stack on the fold line in the opened state.

In a further refinement of the invention, the holding element comprises a carrier rail, which is joined with the spine of the binder and can also be integrated in the binder.

The aforementioned perpendicular section of the holding element can be joined with this carrier rail and/or it can be formed as an angled section of the aforesaid strand-like section.

The strand-like section preferably can be removed from its holding position, in which it borders on the fold and extends parallel to it, to allow removal of the stack of sheets from the binder by, for example, swiveling the section into a position perpendicular to the fold or displacing it parallel to the fold. The strand-like section preferably can be removed from the holding position against the action of spring tension, such that the strand-like section itself can be elastically deformed and can be formed, e.g., by a rubber band.

The invention is explained in greater detail below with reference to the specific embodiments illustrated in the accompanying drawings.

DETAILED DESCRIPTION OF THE INVENTION

Figure 1:
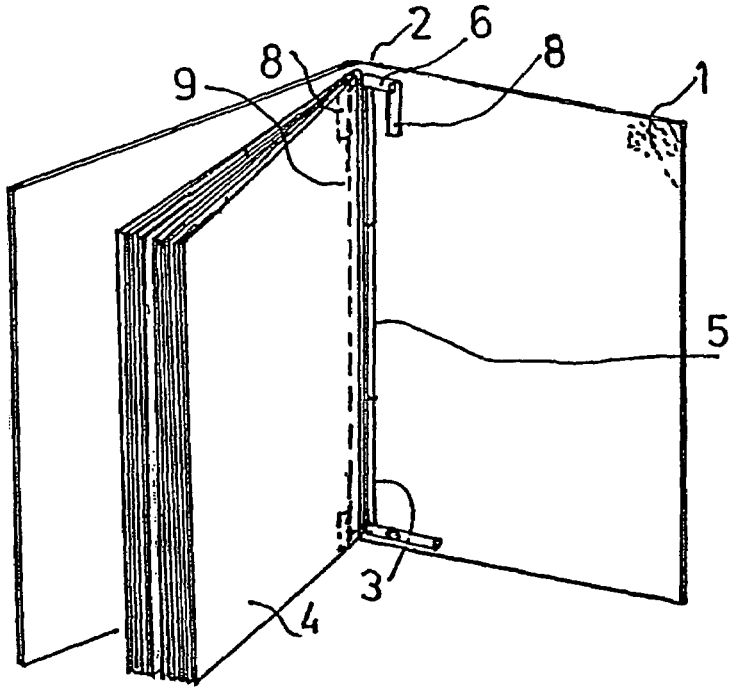
FIG. 1 shows a folded block, which is held in a leather binder by a device in accordance with the invention.

The leather binder 1 shown in FIG. 1 has holding elements 3 mounted on the inside on the binder spine 2 for holding a stack of sheets 4 folded at 9 inside the leather binder.

In the illustrated embodiment, two holding elements 3 are provided in the leather binder 1. One of these holding elements 3 holds the stack of sheets 4 shown in the drawing. Another stack of this type could be held by the other holding element. In a modification of this specific embodiment, additional holding elements could be provided.

Each holding element consists of a carrier rail 5 sewn together with the spine 2 of the leather binder 1. An angled section 6 is formed at each end of the carrier rail 5. The angled sections 6 extend through peripheral recesses 7 formed in the stack of sheets 4. An end piece 8 is formed at the free end of each angled section 6 and can swivel about a joint 10. Along its length, the end piece 8 borders the fold 9 opposite the stack of sheets 4 and holds the stack of sheets on the carrier rail. The joint 10 can have a stiff design or it can lock in the swivel position shown in FIG. 2.

As a result of the angled sections 6 that engage the peripheral recesses 7 and extend perpendicularly to the fold 9, the stack of sheets 4 is secured in the direction perpendicular to the fold 9, which prevents an undesired lateral displacement of the stack of sheets 4, especially in the folded-up state.

In the illustrated embodiment, the peripheral recess 7 is semicircular. It could also be triangular or it could be adapted to the cross-sectional shape of the peripheral angled section that engages it.

By bringing the end pieces 8 into a position perpendicular to the fold 9 of the stack of sheets 4, the stack of sheets can be detached from the holding device 3 to allow it to be used independently of the binder. In this position of the end pieces 8, the stack of sheets can also be reinserted and reattached to the carrier rail 5 by swiveling the end pieces 8 into the position shown in FIG. 2.

Figure 2:
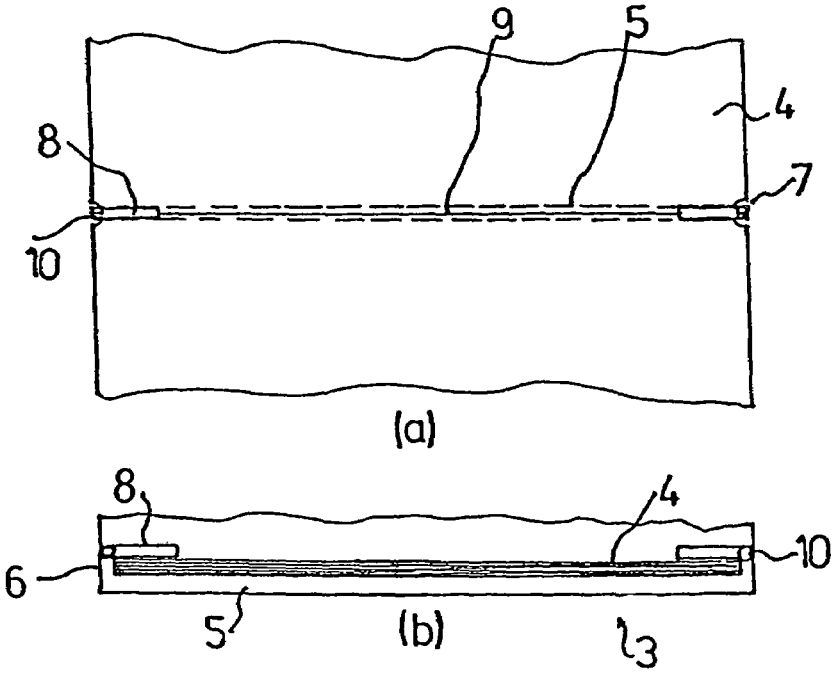
FIG. 2 shows details of the holding device of FIG. 1, FIGS. 3 to 9 show schematic representations of further embodiments of holding devices of the invention.

In the following figures, parts that are the same or have the same function are labeled with the same reference numbers as in FIGS. 1 and 2 but with an appended letter a, b, c . . . , etc.

Figure 3:
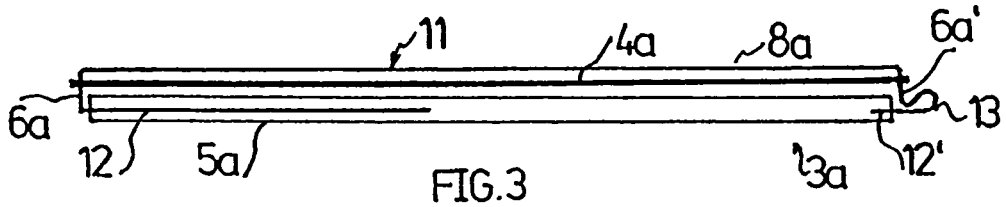

The holding element 3*a* shown in FIG. 3 has a carrier rail 5*a* that is joined, e.g., with a leather binder. The carrier rail 5*a* is constructed as a tube that is open at its ends and is connected with a retaining clip 11 made of spring wire, and a folded stack of sheets 4*a* is enclosed between the retaining clip 11 and the carrier rail 5*a*.

The retaining clip 11 made of spring wire has a section 8*a*, which rests against the stack of sheets 4*a* at its fold and to which angled sections 6*a* and 6*a*' are attached. The angled sections 6*a* and 6*a*' extend perpendicularly to the fold of the stack of sheets 4*a*, and peripheral recesses of the stack of sheets 4*a* engage corresponding peripheral recesses 9.

Attached to the angled section 6*a* is an end piece 12, which is arranged at an angle of 90° to the angled section 6*a* and enters an opening at the end of the tubular rail 5*a*. The angled section 6*a*' is connected with a loop 13, which makes a transition into an end piece 12', which, like the end piece 12, enters an opening at the end of the tubular rail 5*a*.

To release the connection between the stack of sheets 4*a* and the rail 5*a*, the user grips the loop 13 and pulls the end piece 12', which is much shorter than the end piece 12, out of the tubular carrier rail 5*a*. The retaining clip 11 can now be bent aside to release the stock of sheets 4*a* from the carrier rail 5*a* and moved in the opposite direction, which causes the end piece 12 to come out of the rail.

Figure 4:
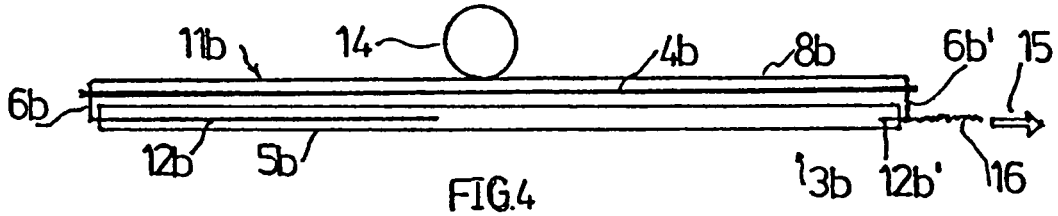

FIG. 4 shows a holding element 3*b* that is similar to the holding element of FIG. 3. In this case, a clip 11*b* made of spring wire with angled sections 6*b* and 6*b*' has a loop 14 in the longitudinal center of a section 8*b* that rests against a stack of sheets 4, which makes it possible to stretch section 8*b* in the direction indicated by the arrow 15. Reference number 12*b* indicates the end piece.

To release the retaining clip 11*b* from the carrier rail 5*b*, a user can pull a strip 16 connected with the retaining clip 11*b* in the direction of the arrow 15.

Figure 5:
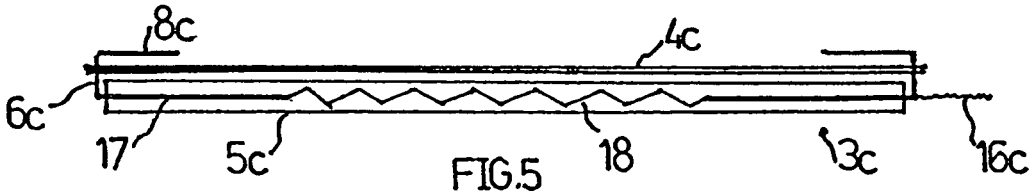

A retaining element 3*c* shown in FIG. 5 has a retaining wire 17 made of spring steel, which is laid over most of its length through a tubular carrier rail 5*c* and is wound to form a spring segment 18 inside the carrier rail. End pieces 8*c* angled once again 90° from angled sections 6*c* hold a stack of sheets 4*c* on the carrier rail 5*c*. When a user pulls the pull strip 16*c*, the stack of sheets 4*c* is released from the clasp of the respective end piece 8*c* and can then be removed from the binder.

Figure 6:
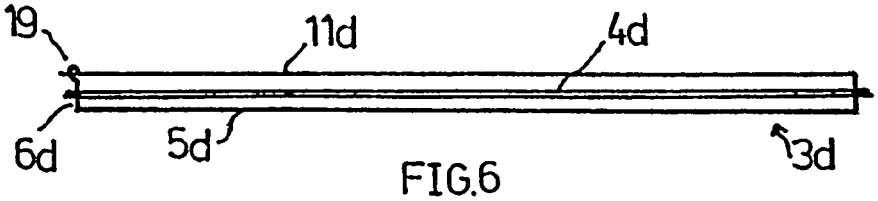

A holding element 3*d* shown in FIG. 6 for holding a stack of sheets 4*d* has a carrier rail 5*d* that is formed as a single piece with a retaining clip 11*d* made of spring steel wire. The retaining clip 11*d* can be hung on an angled end section 6*d* of the carrier rail 5*d* at 19 in the manner of a safety pin.

Figure 7:
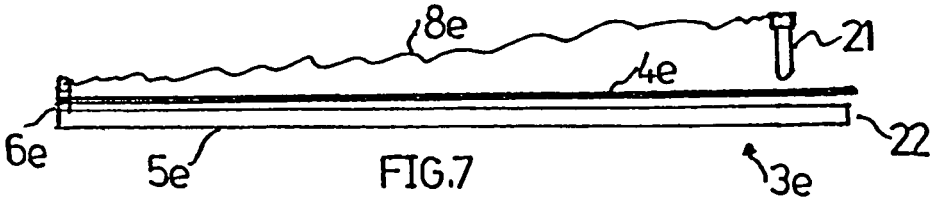

A holding element 3*e* shown in FIG. 7 has a carrier rail 5*e* with an angled end section 6*e*, whose free end is connected with an elastically stretchable band 8*e*, e.g., a rubber band. A pin 21 is attached to the end of the rubber band 8*e* that faces away from the angled end section 6*e*. The pin 21 can be pushed into an opening in the end of the tubular carrier rail 5*e* under tension of the rubber band 8*e* and placement of the rubber band against the inner fold of the stack of sheets 4*e*.

Figure 8:
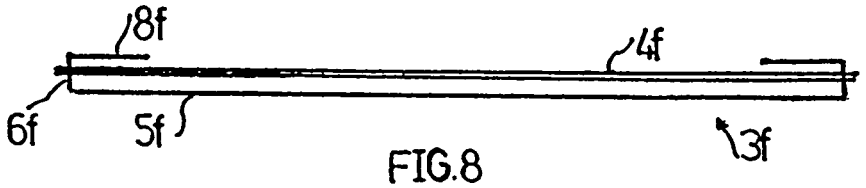

A holding element 3*f* shown in FIG. 8 for holding a stack of sheets 4*f* is formed as a single piece from spring wire to form a carrier rail 5*f* with angled sections 6*f* and with end pieces 8*f* further angled from the angled sections 6*f*.

Figure 9:
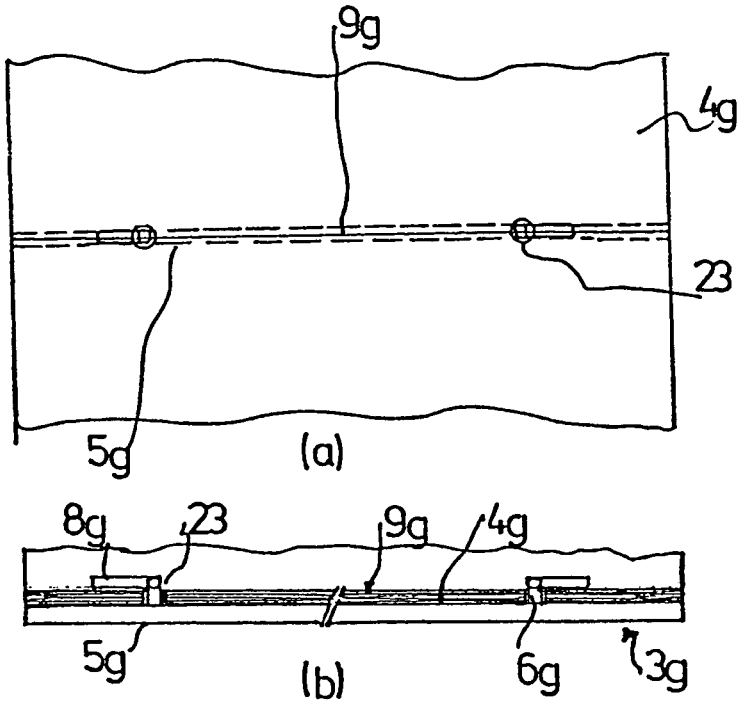

Reference is now made to FIG. 9, which shows an embodiment of a holding element 3*g* for holding a folded stack of sheets 4*g*, in which two passages 23 are formed in the stack of sheets 4*g* instead of the peripheral recesses provided in the preceding embodiments. A pin 6*g* that extends perpendicularly to the fold 9*g* and is connected with the carrier rail 5*g* fits into each of the passages 23. An end piece 8*g* can be swiveled about a joint 10*g*, so that it rests against the fold 9*g* of the stack of sheets 4*g* and grips behind the stack of sheets to connect it with the rail 5*g*.

Naturally, instead of swiveling end pieces 8*g*, a band, possibly one that is elastic, which connects the projecting pins 6*g*, could be used to hold the stack of sheets 4*g* on the carrier rail 5*g*.

Figure 10:
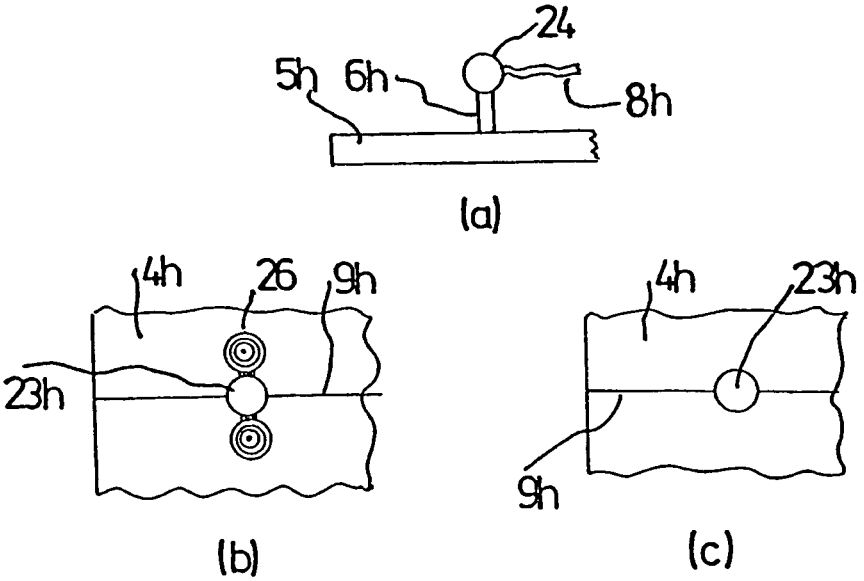
FIG. 10 shows a partial view of another embodiment of a holding device of the invention.

Reference is now made to FIG. 10. A partially drawn carrier rail 5*h* has a pin 6*h* with a spherical head 24. Another pin of this description (not shown) is arranged some distance from the pin 6*h*. A rubber band 8*h* stretched between the spherical heads 24 of the pins holds the stack of sheets 4*h* on the carrier rail 5*h*.

Passages 23*h* with a width equal to the diameter of the spherical heads 24 are formed in the stack of sheets 4*h*.

Some of the sheets in the stack of sheets 4*h* have only the hole 23*h* visible in FIG. 10*c*, these being the sheets facing the spine of the binder. The sheets of the stack that follow these sheets have holes 26 symmetrical to the fold 9*h* with a width that increases from sheet to sheet.

In the state in which the sheets are folded by 90°, the spherical head 24 fills the cavity formed by the holes 26 in the stack of sheets 4*h*. In the folded-up state, after the rubber band 8*h* has been removed, the stack of sheets 4*h* can be detached from the carrier rail 5*h* by passing the spherical heads 24*h* through the holes 23*h*.

Figure 11:
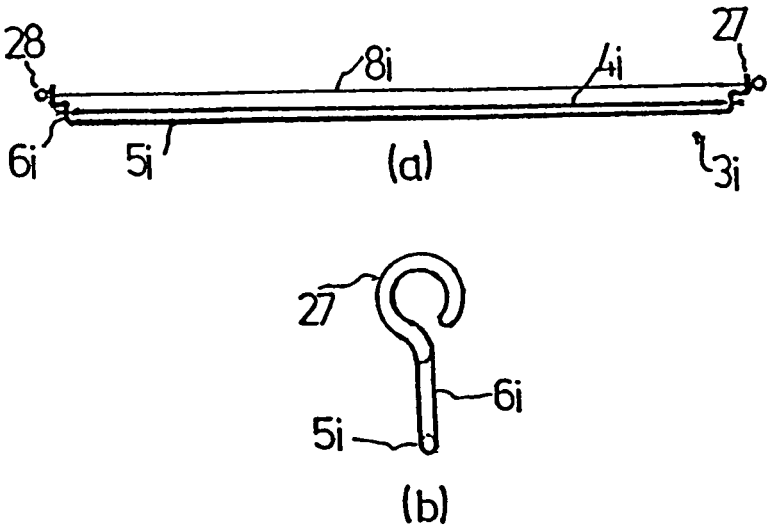
FIGS. 11 and 12 show further embodiments of holding devices according to the invention.

Another holding element 3*i* shown in FIG. 11 has a carrier rail 5*i* with angled sections 6*i*. Each of these angled sections follows two other angled sections, which include angled end sections that are formed as eyes 27. An elastically stretchable band 8*i* can be hung in the eyes 27, and spherical end pieces 28 grip behind the eyes 27. The eyes form a seat for the end pieces which centers the end pieces.

Figure 12:
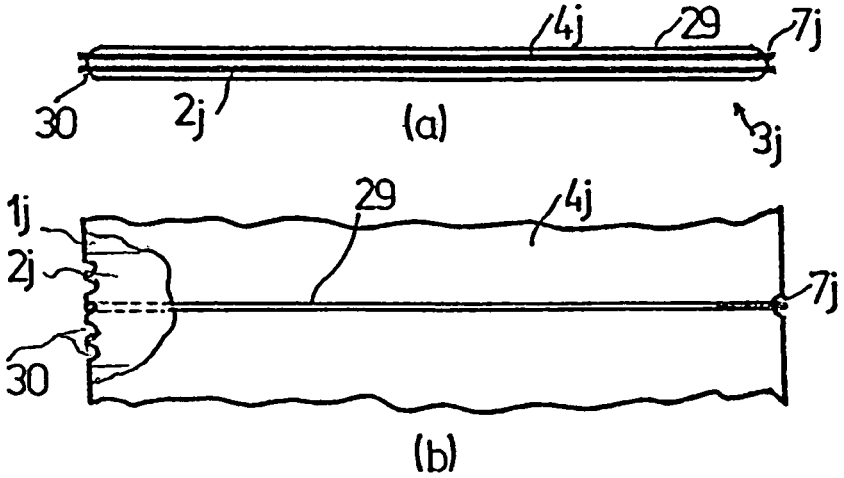

FIG. 12 shows a holding element 3*j* that consists exclusively of a stretchable, closed band 29. The band engages peripheral recesses 7*j* in a stack of sheets 4*j*. The ends of a spine 2*j* of a binder 1 have corresponding peripheral recesses 30 for receiving the band 29. In the open state of the binder 1*j* and the stack of sheets 4*j*, the peripheral recesses 7*j* and 30 prevent both the band 29 and the stack of sheets 4*j* from shifting laterally on the binder 1*j*. As FIG. 12*b* shows, several peripheral recesses 30 are formed on the spine of the binder, corresponding to the number of stacks of sheets to be held in the binder.

The band 29 can be enclosed between two layers of the spine of the binder, so that it is not visible from the outside.

In particular, the inner layer of the two layers could be detachably fastened to the other layer, e.g., by snap fasteners.

The band 29 does not have to be closed. The ends of an open band could be firmly connected with the spine of the binder.

The invention claimed is:

1. A binder (1) of a notebook, comprising: a folded stack (4) of paper sheets held within the binder; and a holding element (3) connected with a spine (2) of the binder (1), wherein the holding element (3) grips behind the innermost paper sheet of the stack (4) at the fold (9), wherein at least one peripheral recess (7) is formed in the stack (4), where a first section (6) of the holding element (3) that extends perpendicularly to the fold (9) enters this peripheral recess (7), and wherein a second section (8) of the holding element (3) that grips behind the innermost paper sheet of the stack (4) has a strand-like design and in a holding position, it borders the fold (9) along an entire length of the fold, wherein the holding element (3*s*) consists exclusively of an elastic band (29), wherein the holding element (3) comprises a carrier rail (5), which is joined with the spine (2) of the binder (1), and wherein the elastic band forms the first section and the second section and the carrier rail of the holding element.

2. A binder in accordance with claim 1, wherein an opening (23) or the at least one peripheral recess (7) is formed symmetrically to the fold (9).

3. A binder in accordance with claim 1, wherein the first section (6) of the holding element (3) that extends perpendicularly to the fold (9) is connected with the carrier rail (5) and/or is formed as an angled section of the second section (8).

4. A binder in accordance with claim 1, wherein the second section (8) can be removed from the aforementioned holding position in order to detach the stack (4) from the binder (1).

5. A binder in accordance with claim 4, wherein the second section (8*a*-8*f*) can be removed from the holding position against the action of spring tension.

6. A binder in accordance with claim 1, wherein the band (29) is closed and spans, besides the stack of sheets (4), at least an inner layer of the spine (2) of the binder.

7. A binder in accordance with claim 1, wherein the holding element (3*j*) is secured on the binder (1*j*) against displacements transverse to the spine (2*j*).

8. A binder in accordance with claim 7, wherein the holding element (3*j*) engages a peripheral recess (30) formed on the spine (2*j*) of the binder (1*j*).

* * * * *

UNITED STATES PATENT AND TRADEMARK OFFICE

CERTIFICATE OF CORRECTION

PATENT NO. : 8,708,372 B2
APPLICATION NO. : 11/990525
DATED : April 29, 2014
INVENTOR(S) : Matthias Büttner It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1095 days.

Signed and Sealed this
Twenty-ninth Day of September, 2015

Michelle K. Lee

Michelle K. Lee
*Director of the United States Patent and Trademark Office*